US007195008B2

(12) United States Patent
Annoura et al.

(10) Patent No.: US 7,195,008 B2
(45) Date of Patent: Mar. 27, 2007

(54) CYLINDER-BY-CYLINDER AIR-FUEL RATIO CONTROLLER FOR INTERNAL COMBUSTION ENGINE

(75) Inventors: Toshiki Annoura, Nagoya (JP); Koichi Hoshi, Susono (JP)

(73) Assignees: Denso Corporation, Kariya (JP); Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 11/410,298

(22) Filed: Apr. 25, 2006

(65) Prior Publication Data

US 2006/0236990 A1 Oct. 26, 2006

(30) Foreign Application Priority Data

Apr. 25, 2005 (JP) ..... 2005-126208

(51) Int. Cl.
*F02D 41/00* (2006.01)
*F02D 41/30* (2006.01)

(52) U.S. Cl. ..... 123/674; 60/276; 701/109

(58) Field of Classification Search ..... 123/673, 123/674, 676, 703, 480; 60/276; 701/109
See application file for complete search history.

(56) References Cited

U.S. PATENT DOCUMENTS

| | | | | |
|---|---|---|---|---|
| 5,806,506 | A | 9/1998 | Kitamura et al. | |
| 7,024,302 | B2 * | 4/2006 | Mizuno et al. | 701/109 |
| 7,051,725 | B2 * | 5/2006 | Ikemoto et al. | 123/673 |
| 2005/0022797 | A1 * | 2/2005 | Ikemoto et al. | 123/673 |
| 2005/0075781 | A1 * | 4/2005 | Mizuno et al. | 701/109 |

FOREIGN PATENT DOCUMENTS

| | | |
|---|---|---|
| JP | 2001-140685 | 5/2001 |

* cited by examiner

*Primary Examiner*—Mahmoud Gimie
(74) *Attorney, Agent, or Firm*—Nixon & Vanderhye P.C.

(57) ABSTRACT

During a learning mode period, the fuel correction coefficient is forcibly changed three times from a situation in which no correction is necessary, whereby the fuel injection quantity of each cylinder is forcibly changed three times. A cross-correlation between the estimated air-fuel ratio and the fuel correction coefficient, which are calculated based on the detected value of the air-fuel ratio sensor every 60° CA, is evaluated to learn a deviation of the air-fuel ratio detecting timing from the appropriate value.

9 Claims, 9 Drawing Sheets

CYLINDER-BY-CYLINDER AIR-FUEL RATIO CONTROLLER FOR INTERNAL COMBUSTION ENGINE

CROSS REFERENCE TO RELATED APPLICATIONS

This application is based on Japanese Patent Applications No. 2005-126208 filed on Apr. 25, 2005, the disclosure of which is incorporated herein by reference.

FIELD OF THE INVENTION

The present invention relates to a cylinder-by-cylinder air-fuel ratio controller for an internal combustion engine. The controller has a function that cylinder-by-cylinder air-fuel ratio is estimated based on signals from a single air-fuel ratio sensor disposed in a confluent portion of exhaust gas.

BACKGROUND OF THE INVENTION

JP-10-73049A (U.S. Pat. No. 5,806,506) shows a cylinder-by-cylinder air-fuel ratio estimating system. In this system, a model representative of a behavior of the exhaust system is established. A single air-fuel ratio sensor is disposed in a confluent portion of the exhaust gas and outputs detected signals. The detected signals are inputted into the model to estimate the air-fuel ratio of each cylinder by means of an observer. A fuel injection quantity to each cylinder is corrected according to a deviation between an estimated air-fuel ratio and a target air-fuel ratio, so that the air-fuel ratio of each cylinder is brought to be consistent with the target air-fuel ratio. Besides, a time delay exists between a time when the exhaust gas flows into a vicinity of the air-fuel ratio sensor and a time when the air-fuel ratio is detected. This time delay is referred to as a response delay of exhaust system hereinafter. Considering that the response delay of exhaust system is varied due to a deterioration of responsiveness of the air-fuel ratio sensor, a deterioration parameter representative of the deterioration degree of the air-fuel ratio sensor is calculated by measuring a response delay of the air-fuel ratio sensor at the time of fuel-cut, and then sample timing (detecting timing) of the air-fuel ratio sensor is corrected based on the deterioration parameter.

However, in this system, when the air-fuel ratio is largely varied due to a disturbance while the response delay of the air-fuel ratio sensor is measured during the fuel-cut, the calculation accuracy of the deterioration parameter is deteriorated, so that the correction accuracy of the air-fuel ratio detecting timing is deteriorated.

JP-2001-140685A shows that when the air-fuel ratio is largely varied due to a disturbance while the response delay of the air-fuel ratio sensor is measured, the measurement of the response delay of the air-fuel ratio sensor is prohibited to avoid a deterioration of the correction accuracy of air-fuel ratio detecting timing.

A behavior at the time when cylinder-by-cylinder air fuel ratio disperses is a combination of the response delay of the exhaust system of each cylinder and the response delay of the air-fuel ratio sensor, which is repeated every 180° CA (in four cylinder engine). Hence, it is not always that the deviation of the air-fuel ratio detecting timing accurately agrees with the deviation of response delay of the air-fuel ratio sensor at the time of fuel-cut. Besides, a time period for correcting the deviation of the air-fuel ratio detecting timing is shorter than a time period of the response delay of the air-fuel ratio sensor. Thus, in the systems shown in JP-10-73049A (U.S. Pat. No. 5,806,506) and JP-2001-140685A, it is hard to accurately correct the deviation of the air-fuel ratio detecting timing.

SUMMARY OF THE INVENTION

The present invention is made in view of the foregoing matter and it is an object of the present invention to provide a cylinder-by-cylinder air-fuel ratio controller capable of accurately learning-correcting the deviation of air-fuel ratio detecting timing of each cylinder while the engine is running.

According to the controller of the present invention, a cylinder-by-cylinder air-fuel ratio estimating means estimates the air-fuel ratio of each cylinder based on a value detected by an air-fuel ratio sensor every air-fuel ratio detecting timings of each cylinder. The air-fuel ratio sensor is disposed in a confluent portion into which exhaust gas flows from each cylinder. A cylinder-by-cylinder air-fuel ratio control means executes a cylinder-by-cylinder air-fuel ratio control in which a fuel injection quantity of each cylinder is corrected based on the estimated air-fuel ratio to decrease a dispersion of the air-fuel ratio between cylinders. A learning means learns an appropriate value of the air-fuel ratio detecting timing or a deviation from the appropriate value. A detected timing correction means corrects the deviation of the air-fuel ratio detecting timing based on a value learned by the learning means during the cylinder-by-cylinder air-fuel ratio control. Furthermore, the learning means forcibly changes the fuel injection quantity of each cylinder during a learning period, and the learning means learns the air-fuel ratio detecting timing based on the estimated air-fuel ratio and the fuel injection quantity. The estimated air-fuel ratio and the fuel injection quantity are calculated based on the value detected by the air-fuel ratio sensor at the air-fuel ratio detecting timing at which an effect due to a change of the fuel injection quantity is arisen.

BRIEF DESCRIPTION OF THE DRAWINGS

The above and other objects, features, and advantages of the present invention will become more apparent from the following detailed description made with reference to the accompanying drawings, in which like parts are designated by like reference number and in which.

DETAILED DESCRIPTION OF THE PREFERRED EMBODIMENTS

Embodiments of the present invention will be described hereinafter with reference to the drawings.

(First Embodiment)

Figure 1:
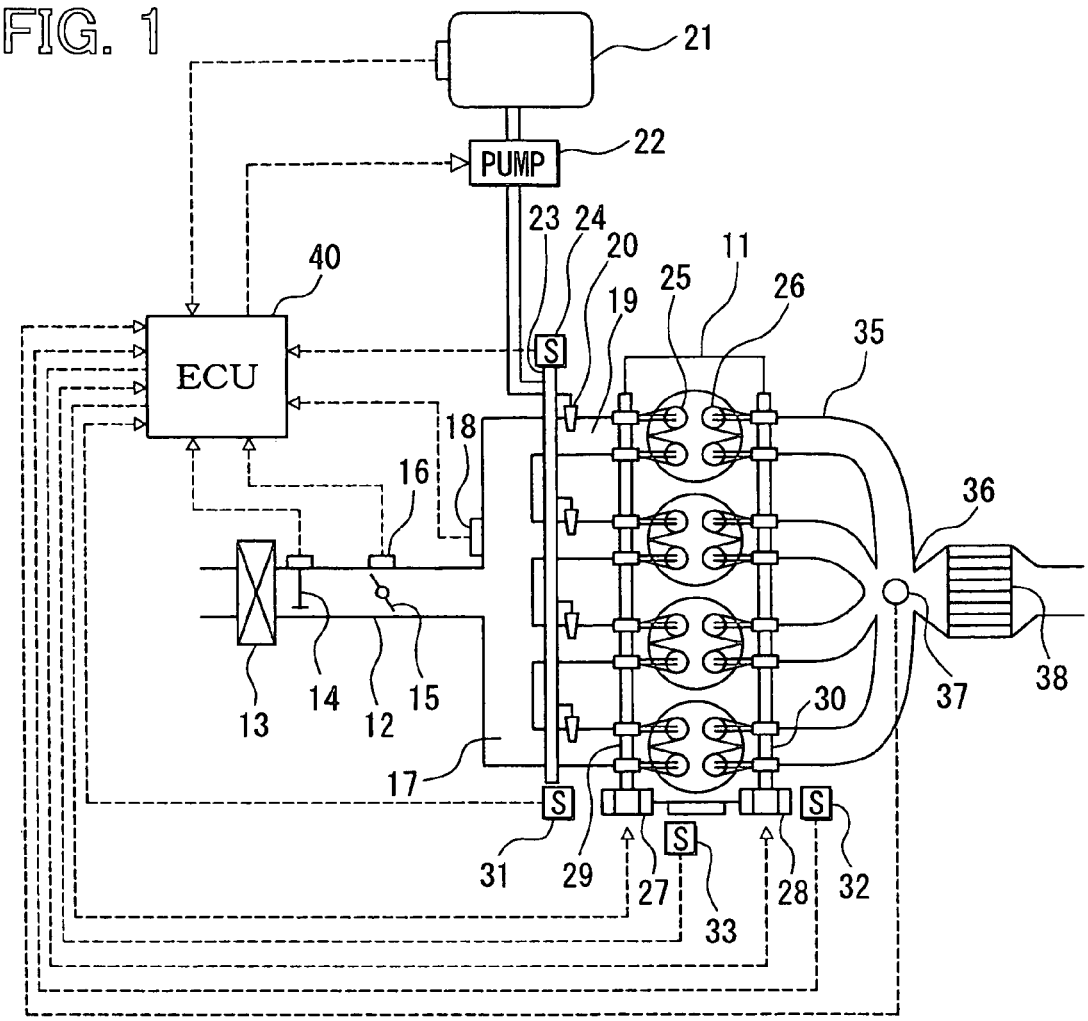
FIG. 1 is a schematic view of an engine control system according to a first embodiment.

Referring to FIGS. 1 to 10, a first embodiment is described. FIG. 1 is a schematic view of an engine control system. An air cleaner 13 is arranged upstream of an intake pipe 12 of an internal combustion engine 11. The engine 11 is an inline four-cylinder engine. An airflow meter 14 detecting an intake air flowrate is provided downstream of the air cleaner 13. A throttle valve 15 driven by a DC-motor and a throttle position sensor 16 detecting a throttle position are provided downstream of the air flow meter 14.

A surge tank 17 including an intake air pressure sensor 18 is provided down stream of the throttle valve 15. The intake air pressure sensor 18 detects intake air pressure. An intake manifold 19 is connected to the surge tank 17. Fuel injectors 20 are mounted on the intake manifold 20 at a vicinity of an intake air port of each cylinder. While the engine 11 is running, fuel in a fuel tank 21 is supplied to the delivery pipe 23 by a fuel pump 22 and then is injected into each cylinder through the fuel injectors 20 at fuel injection timing of each cylinder. The delivery pipe 23 is provided with a fuel pressure sensor 24 for detecting fuel pressure.

The engine 11 is provided with variable valve timing mechanisms 27, 28 which adjust valve timing of an intake valve 25 and a exhaust valve 26. The engine 11 is provided with an intake cam angel sensor 31 and an exhaust cam angle sensor 32, which output cam angle signals in synchronization with an intake cam shaft 29 and an exhaust cam shaft 30. The engine 11 is provided with a crank angle sensor 33 which outputs pulse signals every predetermined crank angle (for example, 30° CA).

An air-fuel ratio sensor 37 detecting a air-fuel ratio of the exhaust gas is provided at a confluent portion 36 of the exhaust gas. Exhaust manifolds 35 of each cylinder converge at the confluent portion 36. A three-way catalyst 38 purifying CO, HC, and NOx in the exhaust gas is provided downstream of the air-fuel ratio sensor 37.

The outputs from the above sensors, such as the air-fuel ratio sensor 37, are inputted into an electronic control unit 40, which is referred to an ECU hereinafter. The ECU 40 includes a microcomputer which executes an engine control program stored in a ROM (Read Only Memory) to control a fuel injection quantity of a fuel injector 20 and an ignition timing based on an engine running condition.

Figure 6:
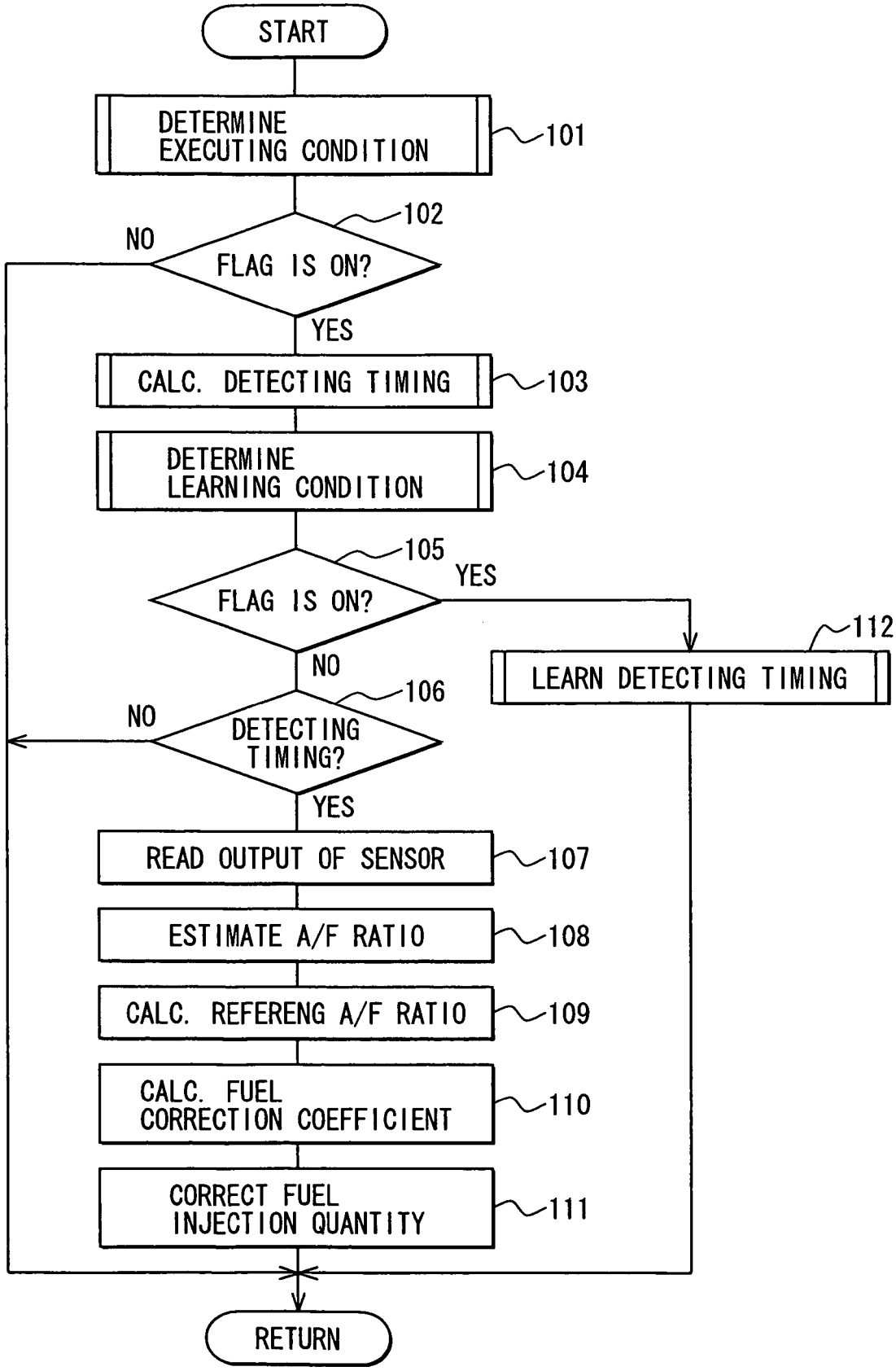
FIG. 6 is a flow chart showing a cylinder-by-cylinder air-fuel ratio control routine according to the first embodiment.

The ECU 40 executes a cylinder-by-cylinder air-fuel ratio control routine shown in FIG. 6, whereby the air-fuel ratio of each cylinder is estimated based on a detected value of the air-fuel sensor 37 by means of a cylinder-by-cylinder air-fuel ratio estimating model in a case when a cylinder-by-cylinder air-fuel ratio control execution condition is established. The detected value of the air-fuel sensor 37 is an actual air-fuel ratio of the exhaust gas flowing through the confluent portion 36. An average of the estimated air-fuel ratio of each cylinder is calculated. The average of the estimated air-fuel ratio is established as a reference air-fuel ratio (target air-fuel ratio for every cylinder), and a deviation between the estimated air-fuel ratio and the reference air-fuel ratio with respect to every cylinder is calculated. A fuel correction coefficient (fuel correction quantity) is calculated to correct the fuel injection quantity of each cylinder, so that the air-fuel ratio of a air-fuel mixture supplied to each cylinder is corrected to decrease the dispersion of air-fuel ratio among cylinders. This process is referred to as a cylinder-by-cylinder air-fuel ratio control, hereinafter. Furthermore, when an air-fuel ratio detecting timing learning condition is established during the cylinder-by-cylinder air-fuel ratio control, the computer learns an appropriate value of the air-fuel ratio detecting timing (sample timing of outputs of air-fuel ratio sensor 37) or a deviation from the most appropriate timing. The deviation of the air-fuel ratio detecting timing is corrected based on the learned value during the cylinder-by-cylinder air-fuel ratio control.

The cylinder-by-cylinder air-fuel ratio estimating model will be described in detail hereinafter. This model is for estimating the air-fuel ratio of each cylinder based on the detected value of the air-fuel ratio sensor 37.

In view of gas-exchange at the confluent portion 36, the detected value of the air-fuel ratio sensor 37 is modeled by multiplying a history of the estimated air-fuel ratio of each cylinder and a history of the detected value of the air-fuel ratio sensor 37 at the confluent portion 36 by a predetermined weight respectively and then integrating them. The air-fuel ratio is estimated by means of this model. Kalman filter is used as an observer.

Specifically, the model of gas-exchange at the confluent portion 36 is approximated based on a following equation (1).

$$ys(t)=k1\times u(t-1)+k2\times u(t-2)-k3\times ys(t-1)-k4\times ys(t-2) \quad (1)$$

wherein "ys" represents the detected value of the air-fuel ratio sensor 37, "u" represents the air-fuel ratio of the gas flowing into the fluent portion 36, and k1–k4 represent constant numbers.

In the exhaust gas system, there are a first order lag due to the gas flowing into and mixed at the confluent portion 36 and a first order lag due to a delay of responsiveness of the air-fuel ratio sensor 37. Hence, in the above equation (1), tow past histories are referred considering these first order lag.

Converting the equation (1) into a state space model, following equations (2a), (2b) are derived.

$$X(t+1)=A\cdot X(t)+B\cdot u(t)+W(t) \quad (2a)$$

$$Y(t)=C\cdot X(t)+D\cdot u(t) \quad (2b)$$

wherein "A", "B", "C", and "D" represent parameters of the model, "Y" represents the detected value of the air-fuel ratio sensor 37, "X" represents the estimated air-fuel ratio of each cylinder as a state variable, and "W" represents a noise.

Designing Kalman filter based on the above equations (2a), (2b), a following equation (3) is derived.

$$\hat{X}(k+1|k)=A\cdot\hat{X}(k|k-1)+K\{Y(k)-C\cdot A\cdot\hat{X}(k|k-1)\} \quad (3)$$

wherein "X^" represents the estimated air-fuel ratio of each cylinder, and "K" represents Kalman gain. X^(k+1|k) corresponds to a calculation in which an estimated air-fuel ratio at a next time (k+1) is obtained based on the estimated air-fuel ratio at a time (k).

As described above, by constructing the cylinder-by-cylinder air-fuel ratio estimating model with Kalman type observer, the air-fuel ratio of each cylinder can be estimated according to an advance of a combustion cycle.

Next, a learning method of the air-fuel ratio detecting timing (sample timing of outputs of the air-fuel ratio sensor 37) will be described hereinafter. Following explanation is based on a case where a four-cylinder engine is provides with the crank angle sensor 33 which outputs pulse signals every 30° CA, and the air-fuel ratio detecting timing is learned every 60° CA.

Figure 2:
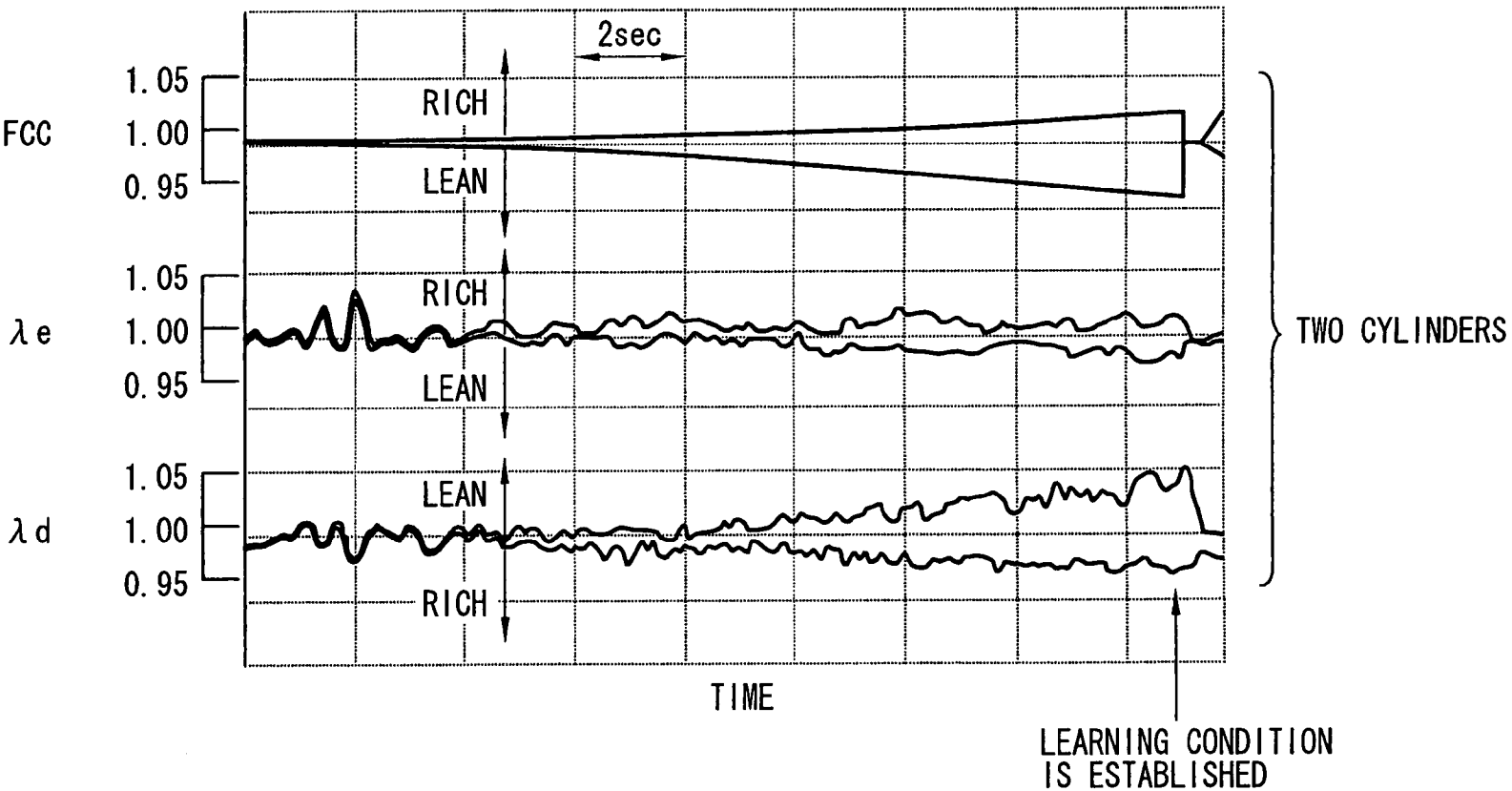
FIG. 2 is a time chart showing a behavior of cylinder-by-cylinder air-fuel ratio control in a case that an air-fuel ratio detecting timing is deviates by 150° CA.

As shown in FIG. 2, when the accuracy of learning correction of the air-fuel ratio detecting timing is deteriorated during the cylinder-by-cylinder air-fuel ratio control, the dispersions of the fuel correction coefficient FCC, the estimated air-fuel ratio λe, and the detected air-fuel ratio λd becomes larger regardless of the cylinder-by-cylinder air-fuel ratio control. This is referred to as a divergence of the cylinder-by-cylinder air-fuel ratio control. On the contrary, when the cylinder-by-cylinder air-fuel ratio control does not diverge, the accuracy of the learning value of the air-fuel ratio detecting timing is ensured, so that it is unnecessary to update the learning value in this situation.

In the first embodiment, when the divergence of the cylinder-by-cylinder air-fuel ratio control is detected, the computer determines that the update of the learning value of the air-fuel ratio detecting timing is necessary and an air-fuel ratio detecting timing learning condition is established. And then, the procedure proceeds to a learning mode.

Here, when a difference between the maximum and the minimum of the fuel correction coefficient FCC of every cylinder is larger than a predetermined value and when a situation in which a difference between the maximum and the minimum of the estimated air-fuel ratio is larger than a predetermined value is consecutively arose over a predetermined times, it is determined that the air-fuel ratio control is diverged. Alternatively, when a difference between the maximum and the minimum of the fuel injection quantity is larger than a predetermined value, or when a difference between the maximum and the minimum of the detected air-fuel ratio of every cylinder is larger than a predetermined value, it is determined that the air-fuel ratio control is diverged.

Figure 3:
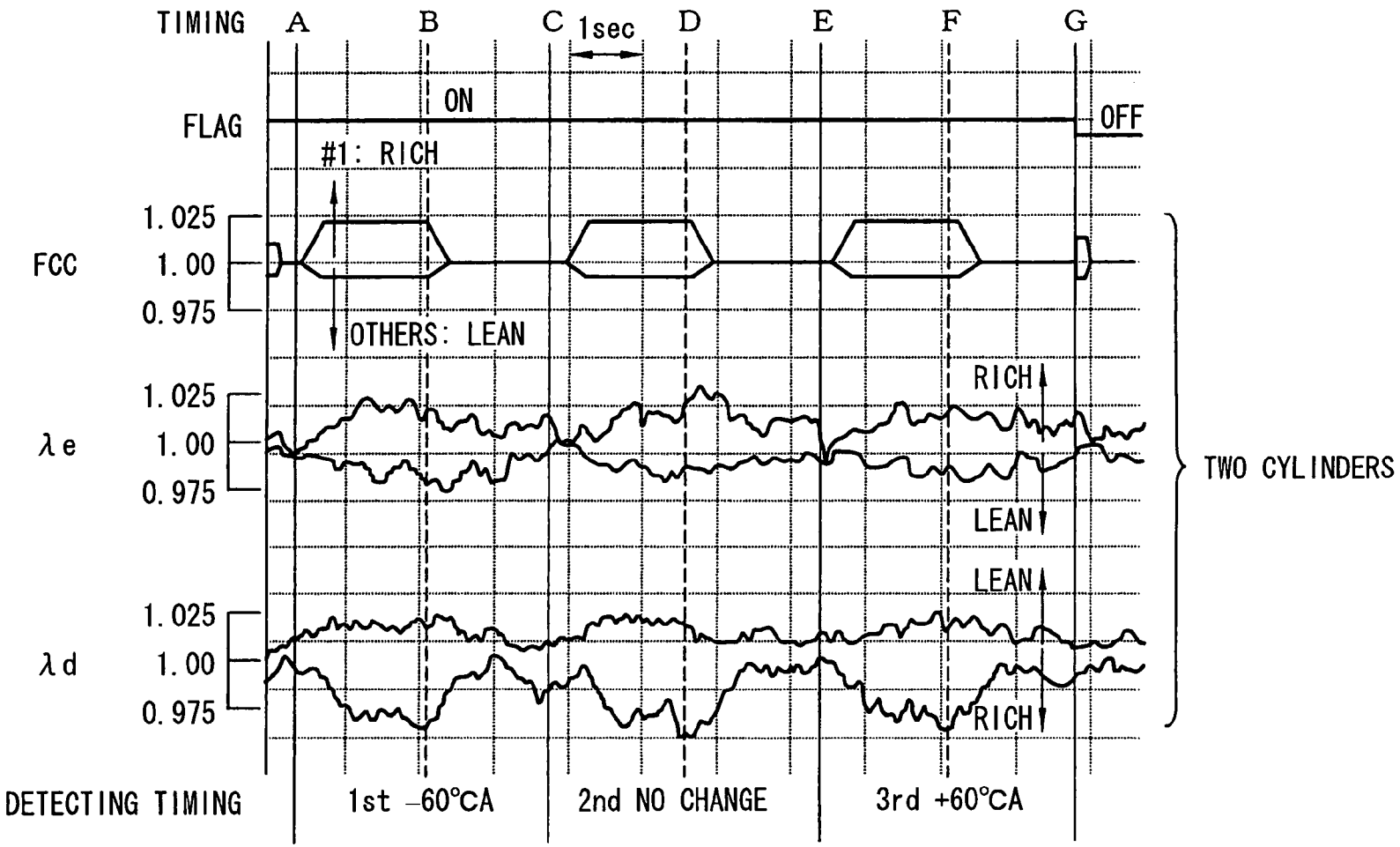
FIG. 3 is a time chart for explaining a learning method of air-fuel ratio detecting timing according to the first embodiment.

During a learning mode period, the fuel correction coefficient FCC is forcibly changed multiple times (for example, three times) from a situation in which no correction is necessary in order to forcibly change the fuel injection quantity of each cylinder multiple times, as shown in FIG. 3. A cross-correlation between the estimated air-fuel ratio λe and the fuel correction coefficient FCC, which are calculated based on the detected value of the air-fuel ratio sensor 37 every 60° CA, is evaluated to learn a deviation of the air-fuel ratio detecting timing from the appropriate value. Alternatively, a cross-correlation between the corrected fuel injection quantity and the estimated air-fuel ratio λe can be evaluated. That is, physical information relating to the fuel injection quantity of each cylinder can be used.

In the case that the fuel correction coefficient FCC of each cylinder is forcibly changed multiple times (three times), the fuel correction coefficient of a specific cylinder (for example, #1 cylinder) is corrected in such a manner as to be rich (or to be lean) by a predetermined percentage from the situation in which no correction is necessary, and the fuel correction coefficients of the other cylinders are corrected in such a manner as to be lean (or to be rich). It is preferable that the total amount of correction of the fuel correction coefficient FCC becomes zero. That is, total amount of changing of fuel injection quantity is substantially zero. For example, the fuel correction coefficient of the specific cylinder is corrected by "A %" toward rich side, and the fuel correction coefficients of the other three cylinders are corrected by "−A/3%" toward lean side. Thereby, even if the fuel correction coefficient FCC of each cylinder is forcibly changed, it is possible that the average air-fuel ratio of exhaust gas flowing into the catalyst 38 is brought to a vicinity of the target air-fuel ratio. Increment of emission due to the forcible change of the fuel correction coefficient during the learning mode period can be avoided.

Figure 4:
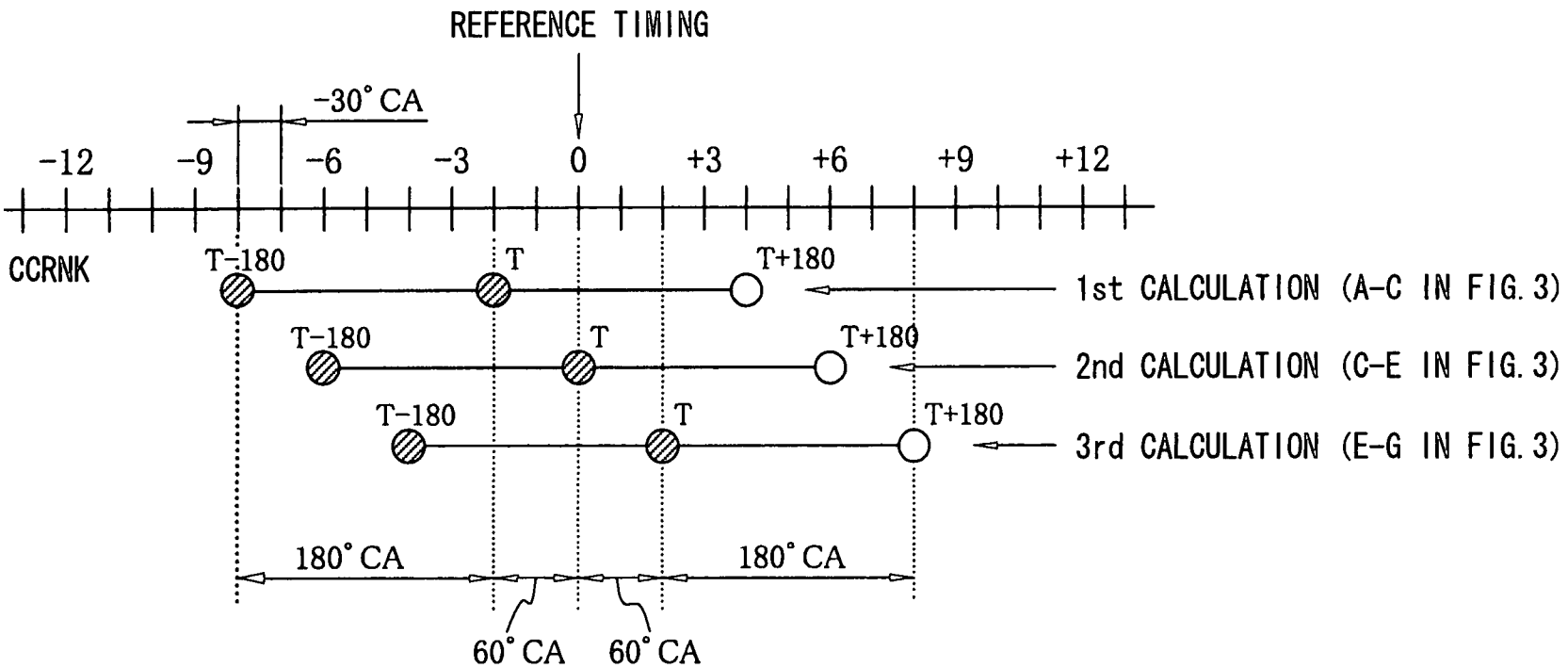
FIG. 4 is a chart for explaining a calculation method of a cross-correlation value according to the first embodiment.

Referring to FIGS. 3 and 4, the evaluation method of the cross-correlation is described hereinafter. In the evaluation methods, the cross-correlation between the estimated air-fuel ratio and the fuel correction coefficient is evaluated in the case that the fuel correction coefficient is forcibly changed. As shown in FIG. 4, an appropriate air-fuel ratio detecting timing of a normal air-fuel ratio sensor 37 is set as a correction crank position CCRNK is zero (CCRNK=0). At the first fuel correction coefficient changing time, the estimated air-fuel ratio of each cylinder is calculated by advancing the air-fuel ratio detecting timing of each cylinder by 60° CA with respect to the reference air-fuel ratio detecting timing (the position CCRNK is changed from 0 to −2) to obtain the variation of the estimated air-fuel ratio of each cylinder in the A–C interval of FIG. 3. Then, the cross-correlation value between the variation of the estimated air-fuel ratio and the variation of the fuel correction coefficient is calculated. Based on following equations (4), (5), and (6), the cross-correlation values CCV(T) at the time when the CCRNK=−2 (T), the cross-correlation value CCV (T+180) at the time when the CCRNK=+4 (T+180), and the cross-correlation value CCV(T−180) at the time when the CCRNK=−8 (T−180) are calculated.

$$CCV(T) = \sum_{n=0}^{3} VFCC(n) \times V\lambda e(n) \tag{4}$$

$$CCV(T+180) = \sum_{n=0}^{3} VFCC(n) \times V\lambda e(n+1) \tag{5}$$

$$CCV(T-180) = \sum_{n=0}^{3} VFCC(n) \times V\lambda e(n-1) \tag{6}$$

wherein "VFCC" represents the variation of the fuel correction coefficient, "Vλe" represents the variation of the estimated air-fuel ratio, and "n" represents the number of cylinder of which crank angel is different from each other by 180° CA. The combustion in cylinder is occurred in a series of number "n". When n=4, it is assumed n=0. When n=−1, it is assumed n=3.

When the CCRNK is −2(T), the variation of the estimated air-fuel ratio and the variation of the fuel correction coefficient are calculated in the $n^{th}$ cylinder. When the CCRNK is +4 (T+180), the variation of the estimated air-fuel ratio is calculated in the $(n+1)^{th}$ cylinder which corresponds to the cylinder of which crank angle is retarded by 180° CA. When the CCRNK is −8 (T−180), the variation of the estimated air-fuel ratio is calculated in the $(n-1)^{th}$ cylinder which corresponds to the cylinder of which crank angle is advanced by 180° CA.

The correction crank position CCRNK represents a deviation from the reference air-fuel ratio detecting timing (reference air-duel ratio detecting crank position) by an increasing and decreasing amount of count value of crank counter which counts the output pulse from the crank angle sensor 33.

At the second fuel correction coefficient changing time, the air-fuel ratio detecting riming of each cylinder is returned to the reference air-fuel ratio detecting timing (CCRNK=0), and then the estimated air-fuel ratio of each cylinder is calculated to obtain the variation of the estimated air-fuel ratio in the C–E interval of FIG. 3. The cross-correlation between the variation of estimated air-fuel ratio and the variation of the fuel correction coefficient in the C–E interval of FIG. 3 is calculated with respect to the correction crank positions CCRNK of −6, 0, and +6 in the same manner as the first fuel correction coefficient changing time.

At the third fuel correction coefficient changing time, the estimated air-fuel ratio is calculated by advancing the air-fuel ratio detecting timing by 60° CA with respect to the reference air-fuel ratio detecting timing (the position CCRNK is changed from 0 to +2) so that the variation of the estimated air-fuel ratio in the E–G interval of FIG. 3 is obtained. The cross-correlation between the variation of estimated air-fuel ratio and the variation of the fuel correction coefficient in the E–G interval of FIG. 3 is calculated with respect to the correction crank positions CCRNK of −4, +2, and +8.

Figure 5:
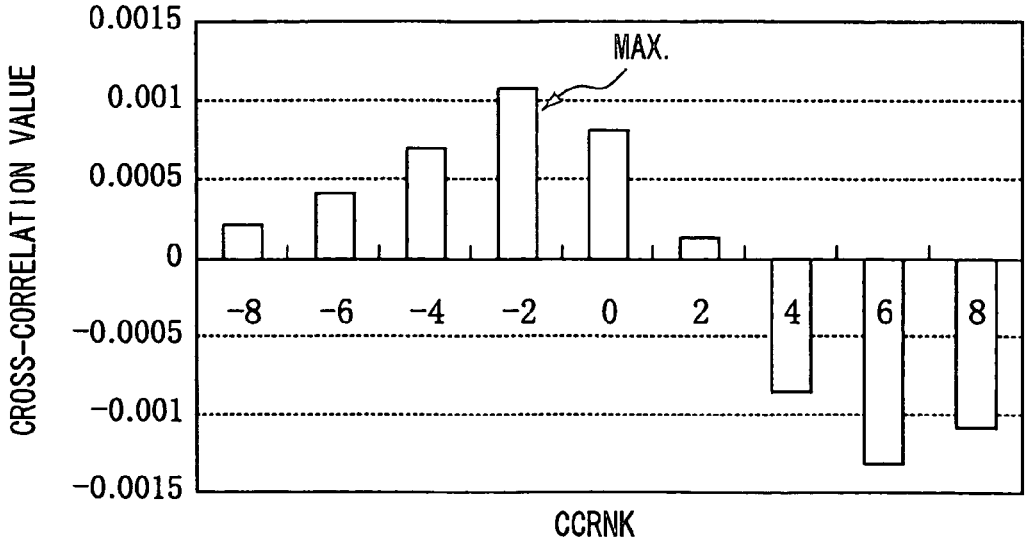
FIG. 5 is a chart for explaining a relationship between a correction crank position CCRNK and the cross-correlation value.

As described above, calculating the cross-correlation value by forcibly changing the fuel correction coefficient three times during the learning mode period, nine cross-correlation values are obtained, in which each correction crank position CCRNK is different from each other by 2 (60° CA) in the rage where the correction crank position CCRNK is from −8 (−240° CA) to +8 (+240° CA). According as the cross-correlation value increase, the cross-correlation between the variation of the estimated air-fuel ratio and the fuel correction coefficient becomes high. According as the cross-correlation between the variation of the estimated air-fuel ratio and the variation of the fuel correction coefficient becomes high, the deviation of the air-fuel detecting timing from the appropriate value becomes small. Thus, in the case of learning the deviation of the air-fuel ratio detecting timing from the appropriate value, the maximum correction crank position CCRNK (−2) in the nine cross-correlation values in FIG. 5 is learned as the deviation of the air-fuel ratio timing from the appropriate value.

In the case that the cross-correlation value disperses, an average of the maximum correction crank angle and the second correction crank angle can be learned. In the embodiment shown in FIG. 5, the value of "−1" (=(−2+0)/2) is learned.

During the air-fuel ratio control, the final air-fuel ratio detecting timing is determined by correcting the reference air-fuel ratio detecting timing based on the learned value of the correction crank position CCRNK, and the air-fuel ratio of each cylinder is estimated based on the detected value of the air-fuel ratio sensor 37 every air-fuel ratio detecting timings of each cylinder.

The fuel correction coefficient can be changed twice or more than four times during the learning mode period. The correction amount of the air-fuel detecting timing can be 30° CA. The correction crank position CCRNK can be established according to the number of cylinders of the engine.

The ECU 40 performs the above learning correction of the air-fuel detecting timing and the cylinder-by-cylinder air-fuel ratio control according to each routine shown in FIGS. 6 to 9.

[Cylinder-by-cylinder Air-fuel Ratio Control Routine]

The cylinder-by-cylinder air-fuel ratio routine shown in FIG. 6 is executed every predetermined crank angle (for example, every 30° CA) in synchronization with the output pulse of the crank angle sensor 33. In step 101, the computer determines whether an executing condition of the cylinder-by-cylinder air-fuel ratio control is established. The executing condition includes following conditions (1) to (4).

(1) The air-fuel ratio sensor 37 is activated.

(2) The air-fuel ratio sensor 37 has no malfunction.

(3) The engine 11 is in warming-up condition.

(4) The engine driving region is a region in which the accuracy of estimation of the air-fuel ratio is ensured.

When the above four conditions are satisfied, the execution condition is established to turn an execution flag ON. When at least one of the four conditions is not satisfied, the execution condition is not established to turn the execution flag OFF.

Figure 9:
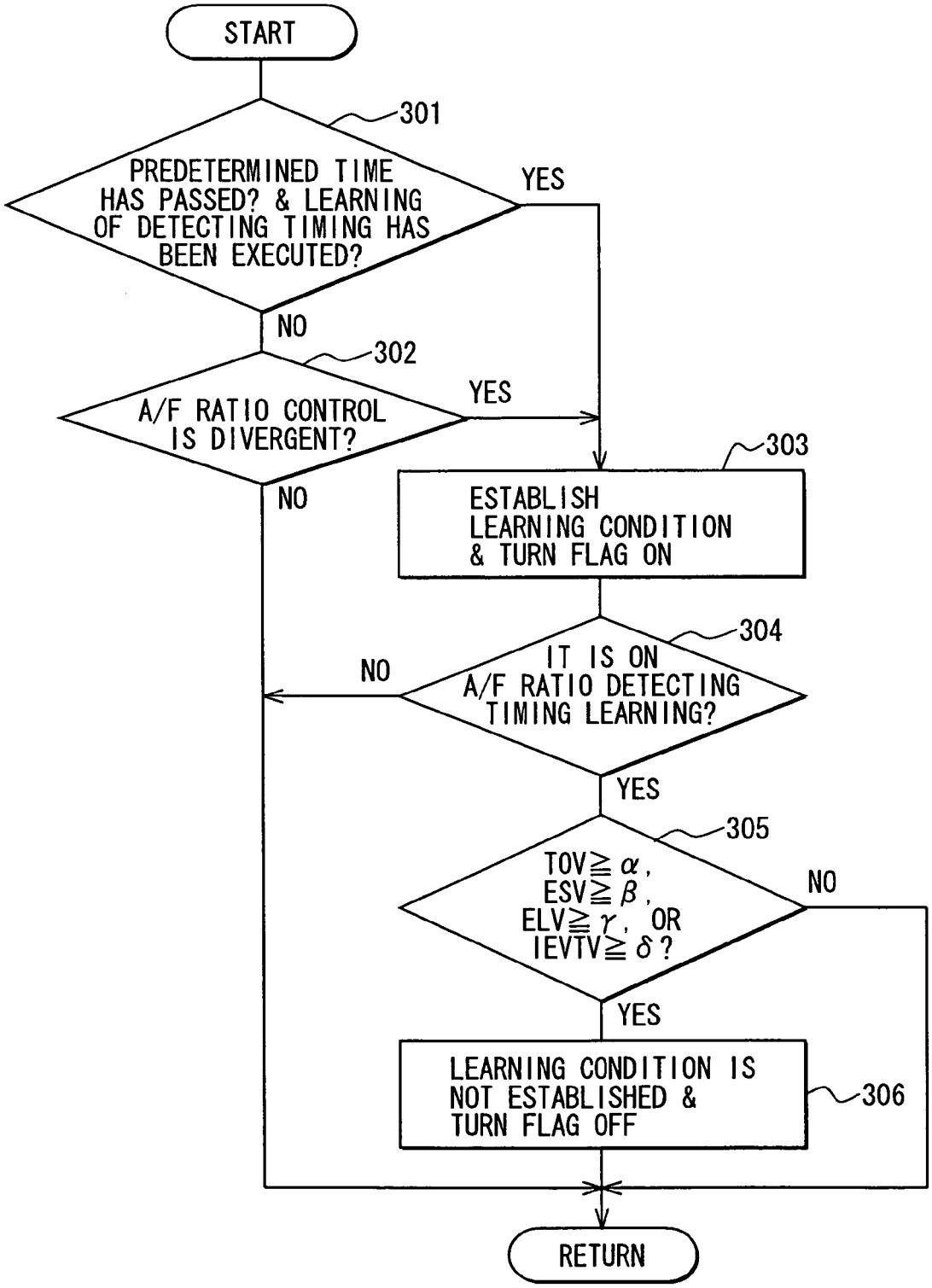
FIG. 9 is a flow chart showing an air-fuel ratio detecting timing learning condition determining routine according to the first embodiment.

In step 102, it is determined whether the execution flag is ON. When the answer is NO, the procedure ends. When the answer is YES, the procedure proceeds to step 103 in which the air-fuel ratio detecting timing is calculated by executing the air-fuel ratio detecting timing calculating routine shown in FIG. 8. Then, the procedure proceeds to step 104 in which the air-fuel-ratio-detecting timing-learning-condition-determining routine shown in FIG. 9 is executed in order to determine whether the air-fuel ratio detecting timing learning condition is established. Based on the result of this determination, the learning execution flag is turned ON/OFF.

In step 105, it is determined whether the learning execution flag is ON. When the answer is NO, the procedure proceeds to step 106 in which it is determined whether the present crank angle is the air-fuel ratio detecting timing established in step 103. When the answer is NO in step 106, the procedure ends.

When the answer is YES is step 106, the procedure proceeds to step 107 in which the outputs of the air-fuel ratio sensor 37 is read. Then, the procedure proceeds to step 108 in which the air-fuel ratio of the subject cylinder is estimated based on the detected value of the air-fuel ratio sensor 37 with the cylinder-by-cylinder air-fuel ratio detecting model.

In step 109, the average of the estimated air-fuel ratios of every cylinder is calculated to be established as the reference air-fuel ratio. In step 110, the deviation between the estimated air-fuel ratio and the reference air-fuel ratio is calculated, and the fuel correction coefficient is calculated in order to decrease the deviation. Then, the procedure proceeds to step 111 in which the fuel injection quantity is corrected based on the fuel correction coefficient of each cylinder to decrease the dispersion of the air-fuel ratio between cylinders.

When it is determined that the learning execution flag is ON in step 105, the procedure proceeds to step 112 in which the air-fuel ratio detecting timing learning routine is executed to learn a deviation between the appropriate value of the air-fuel ratio detecting timing and the reference air-fuel ratio detecting timing.

[Air-fuel Ratio Detecting Timing Learning Routine]

Figure 7:
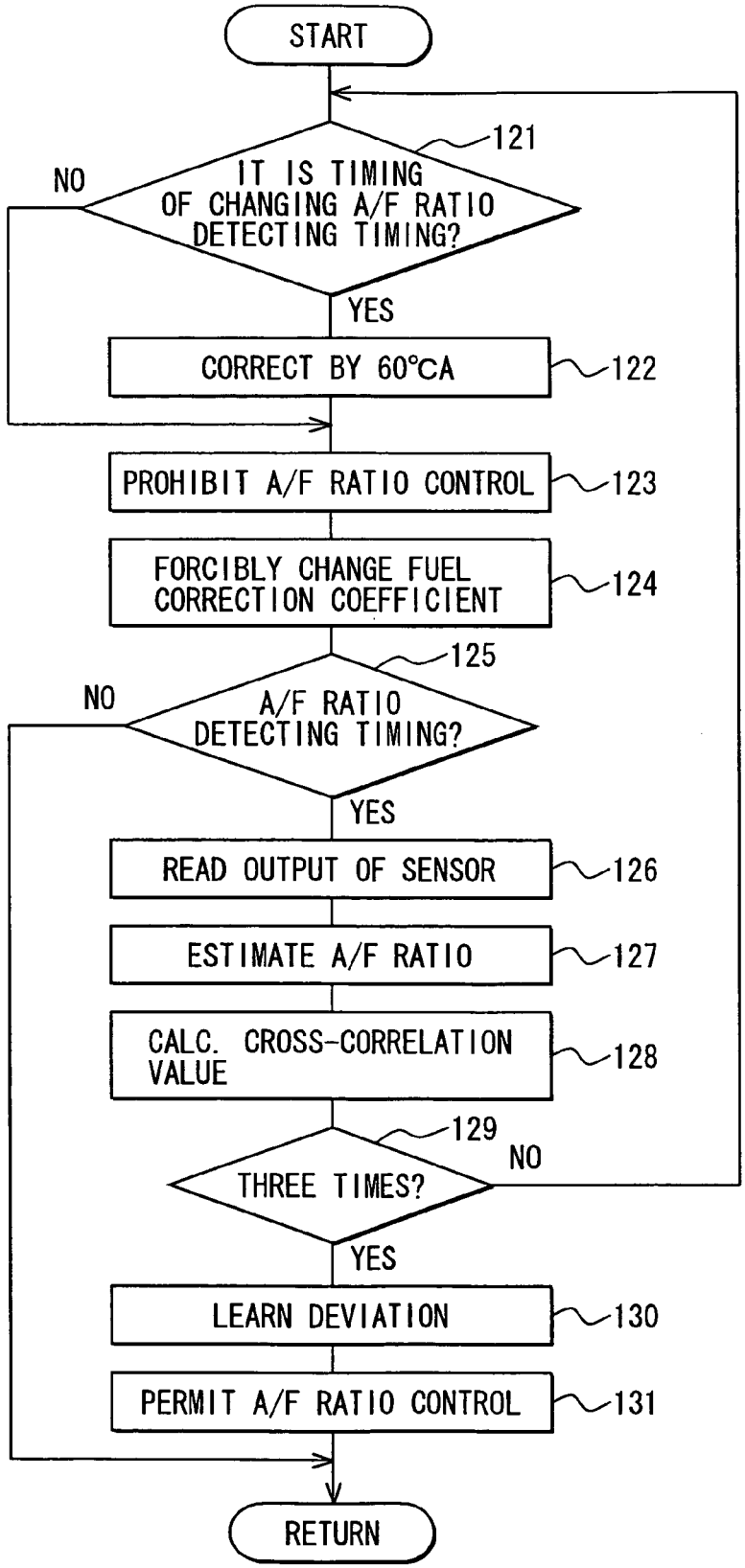
FIG. 7 is a flow chart showing an air-fuel ratio detecting timing learning routine according to the first embodiment.
Figure 8:
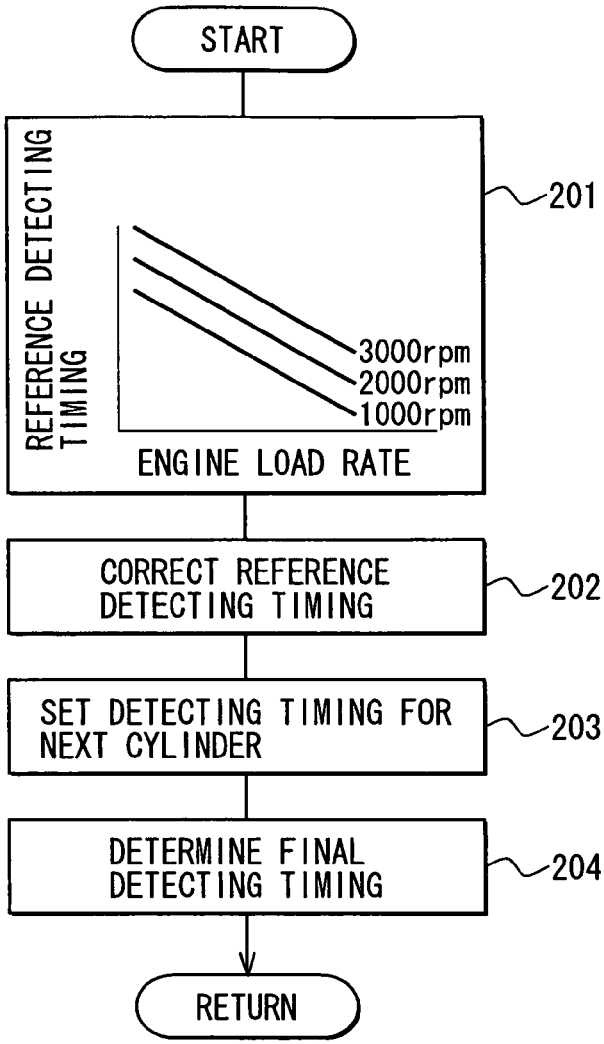
FIG. 8 is a flow chart showing an air-fuel ratio detecting timing calculation routine according to the first embodiment.

An air-fuel ratio detecting timing learning routine shown in FIG. 7 is a subroutine executed in step 112 shown in FIG. 6. In step 121, the computer determines whether it is a timing of changing the air-fuel ratio detecting timing (timing A, C, and E in FIG. 3). When the answer is YES in step 121, the procedure proceeds to step 122 in which the air-fuel ratio detecting timing T is corrected by 60° CA (advance or retard) so that the air-fuel ratio detecting timing T is set to the correction crank position CCRNK of −2, 0 or +2. When the answer is NO in step 121, the air-fuel ratio detecting timing T is not corrected.

Then, the procedure proceeds to step 123 in which the cylinder-by-cylinder air-fuel ratio control is prohibited. Thereby, during the learning mode period, the fluctuation of the air-fuel ratio in each cylinder can be restricted to learn the air-fuel ratio detecting timing under a stable condition in which no effect of the cylinder-by-cylinder air-fuel ratio control exists.

In step 124, the fuel correction coefficient is forcibly changed. It is preferable that the total amount of the variation of the fuel correction coefficient of every cylinder is substantially zero. Then, the procedure proceeds to step 125 in which it is determined whether the present crank angle is the above air-fuel ratio detecting timing. When the answer is NO, the procedure ends without executing the other remaining steps.

When the answer is YES in step 125, the procedure proceeds to step 126 in which the output of the air-fuel ratio sensor 37 is read. Then, the procedure proceeds to step 127 in which the air-fuel ratio of the subject cylinder is estimated based on the detected value of the air-fuel ratio sensor 37 with the cylinder-by-cylinder air-fuel ratio estimating model.

In step 128, the cross-correlation value between the variation of the estimated air-fuel ratio of each cylinder and the variation of the fuel correction coefficient of each cylinder is calculated based on the above equations (4), (5), and (6). Then, the procedure proceeds to step 129 in which it is determined whether the number of correction of the air-fuel ratio detecting times reaches three times. When the answer is NO, the procedure goes back to step 121 and the above processes are repeated.

After the process is repeated three times, in which the cross-correlation value is calculated by correcting the air-fuel ratio detecting timing by 60° CA, the procedure proceeds to step 130. In step 130, the air-fuel ratio detecting timing in which the cross-correlation value is maximum is established as the appropriate air-fuel ratio detecting timing, and then the deviation (the correction crank position CCRNK) between the appropriate air-fuel ratio detecting timing and the reference air-fuel ratio detecting timing is learned.

Figure 10:
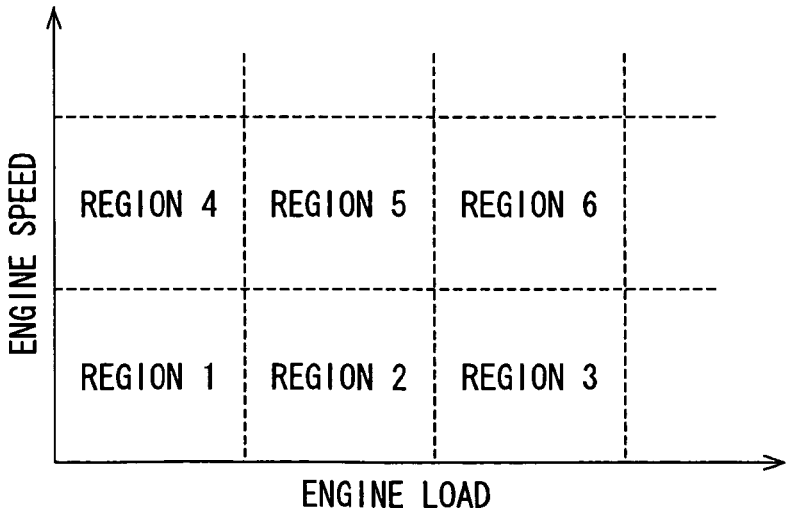
FIG. 10 is a chart schematically showing a learning map according to the first embodiment.

Considering that the appropriate value of the air-fuel ratio detecting timing is varied according to the engine driving condition, the deviation of the air-fuel ratio detecting timing (the correction crank angle position CCRNK) is learned every engine driving regions so that a learning map of the air-fuel ratio detecting timing may be made with a parameter of engine driving region, as shown in FIG. 10. Until the learning value is stored in every region of the learning map, this learning map cannot be used in a region in which the learning value is not stored. In this case, the learning value stored in the region closest to the unlearned region can be used.

Alternatively, in stead of making the learning map of air-fuel ratio detecting timing, the deviation of the air-fuel ratio detecting timing which is commonly used in all driving regions can be learned.

After step 130 in which the deviation is learned, the procedure proceeds to step 131 in which the cylinder-by-cylinder air-fuel ratio control is permitted to end the routine.

[Air-fuel Ratio Timing Detecting Timing Calculation Routine]

An air-fuel ratio timing detecting timing calculation routine is a subroutine which is executed in step 103 of the air-fuel ratio control routine shown in FIG. 6. In step 201, the reference air-fuel ratio detecting timing are calculated based the present engine speed and the engine load rate with the map. The reference air-fuel ratio detecting timing is the appropriate detecting timing of the air-fuel ratio sensor 37 of which responsiveness is normal. For example, the reference air-fuel detecting timing of #1 cylinder is mapped.

In step 202, the reference air-fuel ratio detecting timing is corrected by the correction coefficient which is established based on the exhaust valve timing by means of map. The exhaust valve timing is adjusted by the exhaust valve timing controller. In step 203, the air-fuel ratio detecting timing for the next cylinder is established every combustion interval (180° CA) based on the reference air-fuel ratio detecting timing corrected in step 202. In step 204, the learning value in the learning region which corresponds to the present engine driving region is read from the map shown in FIG. 10, and the final air-fuel ratio detecting timing is determined by correcting the air-fuel ratio detecting timing of each cylinder established in step 203 with the learning value. The present engine driving region is represented by the engine speed, the engine load, and the like.

Alternatively, the reference air-fuel ratio detecting timing may be calculated based on one or two of the engine speed, the engine load rate, the intake vale timing and the exhaust valve timing. Thereby, the reference air-fuel ratio detecting timing is appropriate determined corresponding to the variation of the response delay of the exhaust system.

[Air-fuel Ratio Detecting Timing Learning Condition Determination Routine]

An air-fuel ratio detecting timing learning condition determination routine is a subroutine executed in step 104 shown in FIG. 6. In step 301, it is determined whether a predetermined time has passed since the cylinder-by-cylinder air-fuel ratio control is started, and whether the learning of the air-fuel ratio detecting timing has been executed at least once. When the answer is YES in step 301, the procedure proceeds to step 303 in which it is determined that the air-fuel ratio detecting timing learning condition is established to turn the learning execution flag ON.

When the answer is NO in step 301, the procedure proceeds to step 302 in which the computer determines whether the cylinder-by-cylinder air-fuel ratio control is divergent. When the difference between the maximum and the minimum of the estimated air-fuel ratio is larger than a predetermined value and when this situation is consecutively arisen more than predetermined times, it is determined that the cylinder-by-cylinder air-fuel ratio control is divergent. When the answer is YES in step 302, the procedure proceeds to step 303 in which the computer determines that the air-fuel ratio detecting timing learning condition is established to turn the learning execution flag ON. When the answers are NO in steps 301, and 302, the computer determines that the update of the air-fuel ratio detecting timing is unnecessary, and the procedure ends without executing following steps.

In step 304, the computer determines whether it is on the air-fuel ratio detecting timing learning. When the answer is NO in step 304, the procedure ends. When the answer is YES in step 304, the procedure proceeds to step 305 in which it is determined whether a throttle opening variation TOV is lager than a predetermined value $\alpha$, an engine speed variation ESV is larger than a predetermined value $\beta$, an engine load variation ELV is larger than a predetermined value $\gamma$, or intake/exhaust valve timing variation IEVTV is larger than a predetermined value $\delta$. When the answer is NO, the computer determines that the accuracy of learning of air-fuel ratio detecting timing is ensured to end the routine.

When the answer is YES in step 305, the procedure proceeds to step 306 in which the computer determines that the air-fuel ratio detecting timing learning condition is not established to turn the learning execution flag OFF and to prohibit the learning of the air-fuel ratio detecting timing. Hence, during a transitional period in which the air-fuel ratio of each cylinder deviates due to other than the forcible change of the fuel correction coefficient, the learning of the air-fuel ratio detecting timing is prohibited, so that the learning of the air-fuel ratio detecting timing is executed only when the air-fuel ratio of each cylinder is in stable state.

According to the first embodiment, since the cross-correlation between the estimated air-fuel ratio and the fuel correction coefficient is evaluated with the fuel correction coefficient forcibly changed in order to learn the deviation of the air-fuel ratio detecting timing from the appropriate value, the learning of the air-fuel ratio detecting timing is accurately conducted. Furthermore, the learning process of the air-fuel ratio detecting timing can be performed in multiple steps, so that the calculation load of the ECU 40 is not increased.

(Second Embodiment)

Figure 11:
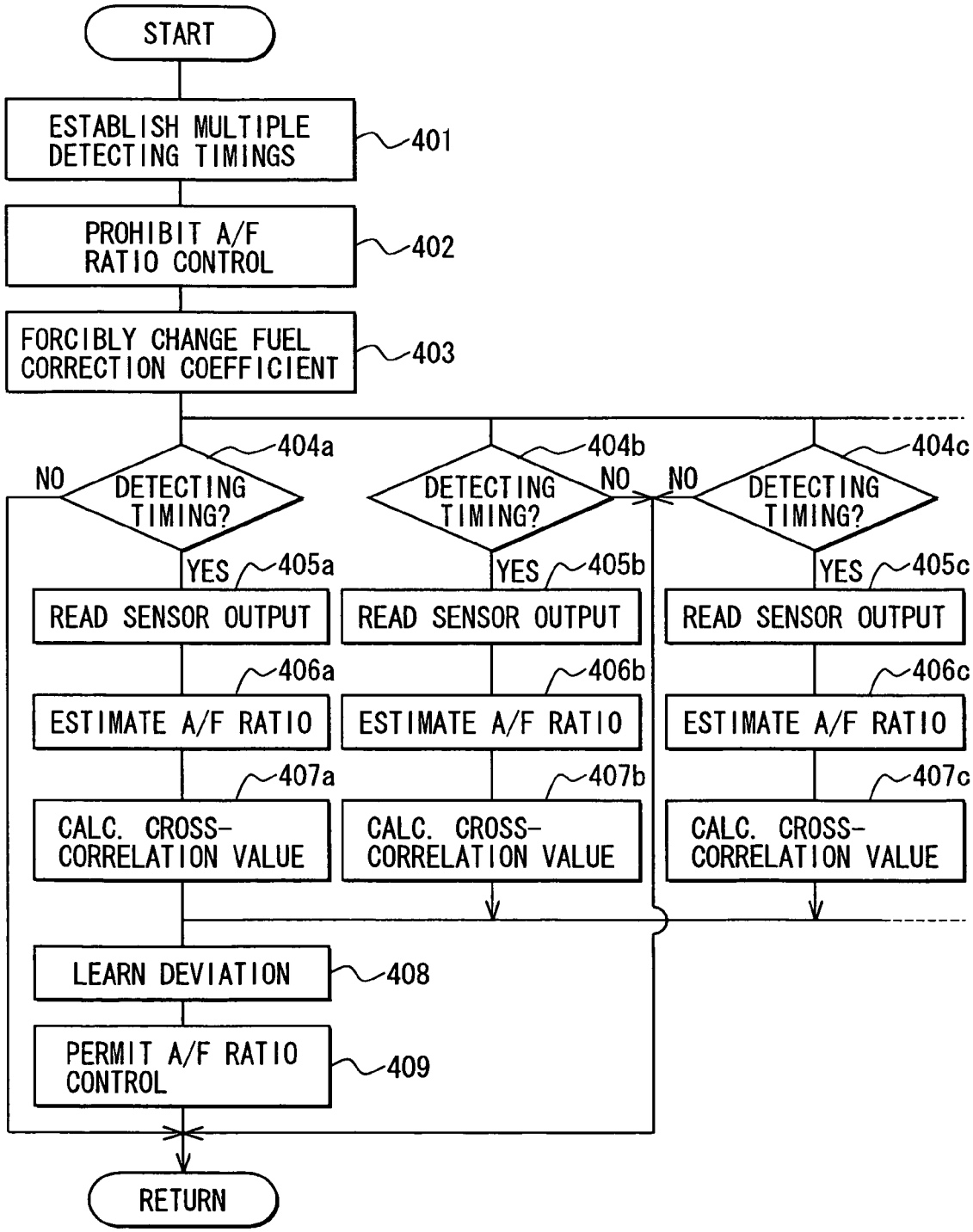
FIG. 11 is a flow chart showing an air-fuel ratio detecting timing learning routine according to a second embodiment.

In a second embodiment, the fuel correction coefficient is changed only once. Referring to FIG. 11, the second embodiment is described in detail hereinafter. FIG. 11 is an air-fuel ratio detecting timing learning routine. The other routines are the same as the first embodiment.

The air-fuel ratio detecting timing is executed while the learning execution flag is ON. In step 401, a plurality of air-fuel ratio detecting timings are established every a predetermined crank angle (for example, 60° CA) in a crank angle interval in which an effect is arisen by forcibly changing the furl correction coefficient once. Then, the procedure proceeds to step 402 in which the cylinder-by-cylinder air-fuel ratio control is prohibited. In step 403, the fuel correction coefficient of each cylinder is forcibly changed. It is preferable that the total amount of variations of the fuel correction coefficient of every cylinder is substantially zero.

Then, the procedure proceeds to steps 404*a*, 404*b*, 404*c*, and followings. The number of steps 404*a*, 404*b*, 404*c*, and followings is the same as the number of the air-fuel detecting timing established in step 401. In each step 404*a*, 404*b*, 404*c*, and followings, the computer determines whether the present crank angle is the air-fuel ratio detecting timing established in step 401. When the answer is NO, the procedure ends without executing the following steps.

When the answer is YES in one of steps 404*a*, 404*b*, 404*c*, and followings, the procedure proceeds to step 405 (405*a*, 405*b*, 405*c*, or followings) in which the output of the air-fuel ratio sensor 37 is read. Then, the procedure proceeds to step 406 (406*a*, 406*b*, 406*c*, or followings) in which the air-fuel ratio of the subject cylinder is estimated based on the detected value of the air-fuel ratio sensor 37.

In step 407 (407*a*, 407*b*, 407*c*, or followings), the cross-correlation value between the variation of the estimated air-fuel ratio of each cylinder and the variation of the fuel correction coefficient of each cylinder is calculated according to the above equations (4), (5), and (6).

After calculating the cross-correlation values at a plurality of air-fuel ratio detecting timings which are different from each other, the procedure proceeds to step 408. In step 408, the cross-correlation values of each air-fuel ratio detecting timing are compared with each other to set the air-fuel detecting timing as the proper air-fuel ratio detecting timing, in which the cross-correlation value is maximum value. And then the deviation (the correction crank position CCRNK) between the appropriate air-fuel ratio detecting timing and the reference air-fuel ratio detecting timing is learned. In step 409, the cylinder-by-cylinder air-fuel ratio control is executed.

According to the second embodiment, the deviation between a plurality of air-fuel ratio detecting timings can be evaluated with the cross-correlation under the same driving condition, so that the accuracy of learning of air-fuel ratio detecting timing is improved. Furthermore, since the deviation can be evaluated based on a single change of the fuel correction coefficient, the learning period can be reduced.

The present invention can be applied to a direct injection engine as well as an intake port injection engine.

What is claimed is:

1. A cylinder-by-cylinder air-fuel ratio controller for an internal combustion engine, comprising:

a cylinder-by-cylinder air-fuel ratio estimating means for estimating the air-fuel ratio of each cylinder based on a value detected by an air-fuel ratio sensor every air-fuel ratio detecting timings of each cylinder, the air-fuel ratio sensor being disposed in a confluent portion into which exhaust gas flows from each cylinder;

a cylinder-by-cylinder air-fuel ratio control means for executing a cylinder-by-cylinder air-fuel ratio control in which a fuel injection quantity of each cylinder is corrected based on the estimated air-fuel ratio to decrease a dispersion of the air-fuel ratio between cylinders;

a learning means for learning an appropriate value of the air-fuel ratio detecting timing or a deviation from the appropriate value; and a detected timing correction means for correcting the deviation of the air-fuel ratio detecting timing based on a value learned by the learning means during the cylinder-by-cylinder air-fuel ratio control, wherein the learning means forcibly changes the fuel injection quantity of each cylinder during a learning period, and the learning means learns the air-fuel ratio detecting timing based on the estimated air-fuel ratio and the fuel injection quantity, which are calculated based on the value detected by the air-fuel ratio sensor at the air-fuel ratio detecting timing at which an effect due to a change of the fuel injection quantity is arisen.

2. A cylinder-by-cylinder air-fuel ratio controller for an internal combustion engine according to claim 1, wherein the learning means forcibly changes the fuel injection quantity of each cylinder a plurality of times during the learning period, and the learning means learns the air-fuel ratio detecting timing based on a cross-correlation between the estimated air-fuel ratio of each cylinder and the fuel injection quantity of each cylinder, which are calculated based on the value detected by the air-fuel ratio sensor every air-fuel ratio detecting timings in which the fuel injection quantity is changed.

3. A cylinder-by-cylinder air-fuel ratio controller for an internal combustion engine according to claim 1, wherein the learning means forcibly changes the fuel injection quantity of each cylinder once during the learning period, the learning means establishes a plurality of air-fuel ratio detecting timing during a period in which an effect due to a change of the fuel injection quantity is arisen, and the learning means learns the air-fuel ratio detecting timing based on a cross-correlation between the estimated air-fuel ratio of each cylinder and the fuel injection quantity of each cylinder, which are calculated based on the value detected by the air-fuel ratio sensor every air-fuel ratio detecting timings.

4. A cylinder-by-cylinder air-fuel ratio controller for an internal combustion engine according to claim 1, wherein the learning means set a variation of the fuel injection amount of each cylinder in such a manner that a total amount of the variation becomes substantially zero when the fuel injection quantity of each cylinder is forcibly changed during the learning period.

5. A cylinder-by-cylinder air-fuel ratio controller for an internal combustion engine according to claim 1, wherein the detected timing correction means calculates a reference air-fuel ratio detecting timing based on at least one of an internal combustion engine speed, an internal combustion engine load, an intake valve timing, and an exhaust valve timing, and the detected timing correction means determines a final air-fuel ratio detecting timing by correcting the reference air-fuel ratio detecting timing based on a learning value of the learning means.

6. A cylinder-by-cylinder air-fuel ratio controller for an internal combustion engine according to claim 1, wherein the learning means includes a means for prohibiting the cylinder-by-cylinder air-fuel ratio control during the learning period.

7. A cylinder-by-cylinder air-fuel ratio controller for an internal combustion engine according to claim 1, wherein the learning means includes a means for prohibiting the cylinder-by-cylinder air-fuel ratio control when any one of variations of a throttle position, an internal combustion engine speed, an internal combustion engine load, an intake valve timing, and the exhaust valve timing exceeds a predetermined value.

8. A cylinder-by-cylinder air-fuel ratio controller for an internal combustion engine according to claim 1, wherein the learning means learns the air-fuel ratio detecting timing every driving regions of the internal combustion engine.

9. A cylinder-by-cylinder air-fuel ratio controller for an internal combustion engine according to claim 1, wherein the learning means learns the air-fuel ratio detecting timing when a divergence of the cylinder-by-cylinder air-fuel ratio control is detected.

* * * * *